US007403168B2

(12) United States Patent
Ohara

(10) Patent No.: US 7,403,168 B2
(45) Date of Patent: Jul. 22, 2008

(54) ANTENNA DEVICE AND COMMUNICATIONS SYSTEM USING THE SAME

(75) Inventor: Masahiro Ohara, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 50 days.

(21) Appl. No.: 11/507,591

(22) Filed: Aug. 22, 2006

(65) Prior Publication Data

US 2007/0091003 A1 Apr. 26, 2007

(30) Foreign Application Priority Data

Oct. 20, 2005 (JP) ..... 2005-305492

(51) Int. Cl.
*H01Q 1/32* (2006.01)
*H01Q 7/08* (2006.01)

(52) U.S. Cl. ..... 343/713; 343/788

(58) Field of Classification Search ..... 343/711, 343/713, 787, 788

See application file for complete search history.

(56) References Cited

U.S. PATENT DOCUMENTS 6,400,330 B1 * 6/2002 Maruyama et al. ..... 343/788
6,522,241 B1 * 2/2003 Baudard ..... 340/5.61
6,621,178 B2 * 9/2003 Morillon ..... 307/10.5
7,271,711 B2 * 9/2007 Daiss et al. ..... 340/447

FOREIGN PATENT DOCUMENTS

JP 2001-520337 10/2001
WO WO 99/19585 4/1999

* cited by examiner

*Primary Examiner*—Tan Ho
(74) *Attorney, Agent, or Firm*—McDermott Will & Emery LLP

(57) ABSTRACT

An antenna made by winding a coil on the periphery of a rod-like core made of a magnetic material is housed inside a pillar having a relatively small width and disposed in a manner such that its axis line is nearly orthogonal to the vertical axis line of the pillar. With this arrangement, a predetermined communication range is secured as the electromagnetic waves radiated from the antenna are barely absorbed by the vehicle body and radiated to inside the cabin as well as to the outside. Accordingly, an inexpensive antenna device and a communications system using it are provided which enable communication with a portable device inside and outside a vehicle cabin using a single antenna.

4 Claims, 4 Drawing Sheets

ANTENNA DEVICE AND COMMUNICATIONS SYSTEM USING THE SAME

FIELD OF THE INVENTION

The present invention relates to antenna devices to be installed in vehicles for communications primarily with portable devices and communications systems using the same.

BACKGROUND OF THE INVENTION

In recent years, locking and unlocking of vehicle doors at a distance by means of a portable device carried by drivers are generally practiced in addition to locking and unlocking vehicle doors directly with a key. Along with this trend, an antenna device and a communications system using the antenna device for enabling secure communication with a portable device are being demanded.

Japanese Translation of PCT Publication No. 2001-520337 discloses a configuration of an antenna device in a conventional communications system in which an antenna is disposed in the vicinity of the opening/closing section, for example, inside a doorknob.

Referring to FIG. 5 and FIG. 6, a description will be given on this conventional antenna device and a communications system using it.

FIG. 5 is a perspective view of a conventional antenna device. As shown in FIG. 5, antenna 5 of the conventional antenna device is disposed inside knob 2 made of resin provided on door 1 which is made of a metallic chassis such as a steel plate. And, knob 2 is provided in a manner such that its right end is swingable relative to door 1. Also, antenna 5 is formed by winding a coil on the periphery of a rod-like core of a magnetic material. Antenna 5 is housed in a hollow space inside knob 2 in a manner such that its axis line is parallel to door 1.

FIG. 6 is a diagram to show an example of a conventional antenna device configuration and a communications system that uses the antenna device. FIG. 6 also shows an example of directivity characteristics of a conventional antenna device. As shown in FIG. 6, antenna 5 is connected to control circuit 4 provided on a vehicle. The communications system is so configured that control circuit 4 communicates with a portable device (not shown) carried by a driver through antenna 5.

In the above configuration, when a driver carrying a portable device approaches the vehicle and enters the region of communication range D, control circuit 4 communicates with the portable device through antenna 5. On identifying the driver, control circuit 4 drives a locking mechanism (not drawn) such as a solenoid and door 1 is unlocked.

Also, when the driver leaves the vehicle to outside of the region of communication range D, control circuit 4 becomes unable to communicate with the portable device. The system is so configured that, in such a case, conversely to what is described above, control circuit 4 drives the locking mechanism and locks door 1.

In such a conventional communications system, antenna 5 is housed inside knob 2 on the front right and left sides of a vehicle in a manner such that its axis line is parallel to door 1. As a result, antenna 5 radiates electromagnetic waves as shown by an example of antenna directivity characteristics of FIG. 6. Accordingly, the communication range of a conventional communications system is as represented by communication range D due to the electromagnetic waves radiated outwardly of vehicle 6.

That is, as the inner metallic door 1 is overwhelmingly large compared with small antenna 5 disposed with its axis line parallel to door 1, the inward magnetic field of antenna 5 makes a magnetic path via door 1 and the inwardly radiated electromagnetic waves are absorbed by door 1. Accordingly, the electromagnetic waves are radiated from antenna 5 only outwardly to communication range D.

For the reason described above, when a driver is in the vehicle cabin, communication with a portable device carried by the driver is not possible with antenna 5 alone that is housed inside knob 2. Accordingly, in a conventional communications system, another antenna (not drawn) connected to control circuit 4 is usually provided in the cabin to enable communication with a portable device.

Also, as antenna 5 is close to metallic door 1 and radiated electromagnetic waves are absorbed by door 1, radiation efficiency of antenna 5 is low, requiring an antenna current of the order of 1.0 A in order to secure outward communication range of about 1 m in radius, thus resulting in a relatively large consumption of electric power.

As has been described, with the above conventional antenna device and a communications system using the antenna device, a separate antenna was necessary in order to communicate with a portable device in the vehicle cabin. Accordingly, the configuration of the antenna device suffers a problem of a complicated structure and expensive cost.

SUMMARY OF THE INVENTION

The antenna device in accordance with the present invention is configured by housing an antenna made by winding a coil around the periphery of a rod-like core of a magnetic material inside a pillar of a vehicle and disposing the antenna in a manner such that its axis line is orthogonal to the vertical axis line of the pillar. By disposing an antenna inside a pillar with a relatively small width different from doors, and in a direction orthogonal to the vertical direction of the pillar, the electromagnetic waves radiated from the antenna are barely absorbed by the vehicle body and radiated into the cabin as well as to the outside. As a result, a predetermined communication range is secured. Accordingly, an antenna device is obtained that is capable of communicating with a portable device inside or outside a vehicle cabin with a single antenna and inexpensive in cost.

The antenna device and the communications system using the antenna device include an antenna device, a control circuit connected to the antenna device and a portable device that can be carried, and the control circuit and the portable device communicate through the antenna device. A communications system simple in configuration and inexpensive in cost is thus realized.

DETAILED DESCRIPTION OF PREFERRED EMBODIMENT

Referring to drawings, a description of preferred embodiments of the present invention will be given below.

Preferred Embodiment

Figure 1:
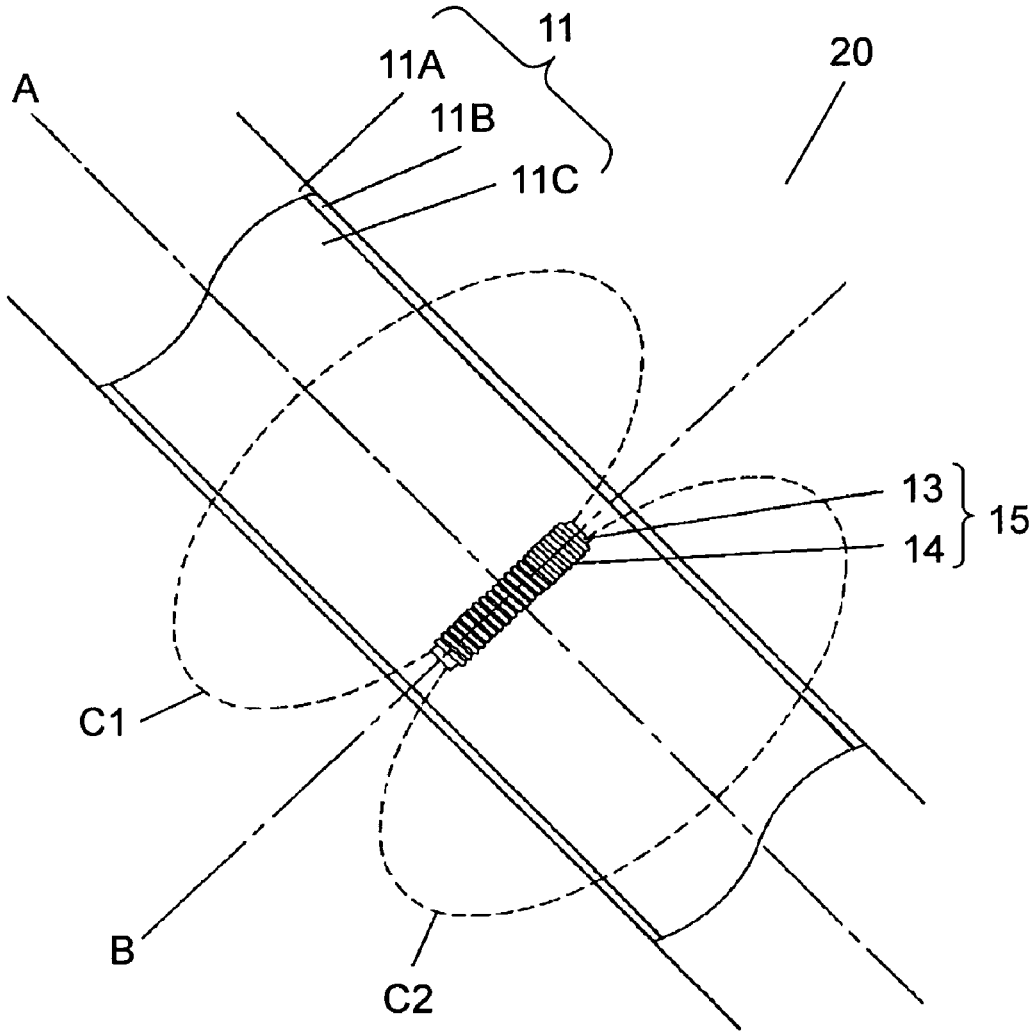
FIG. 1 is a fragmentary sectional view of an antenna device in a preferred embodiment of the present invention.
Figure 2:
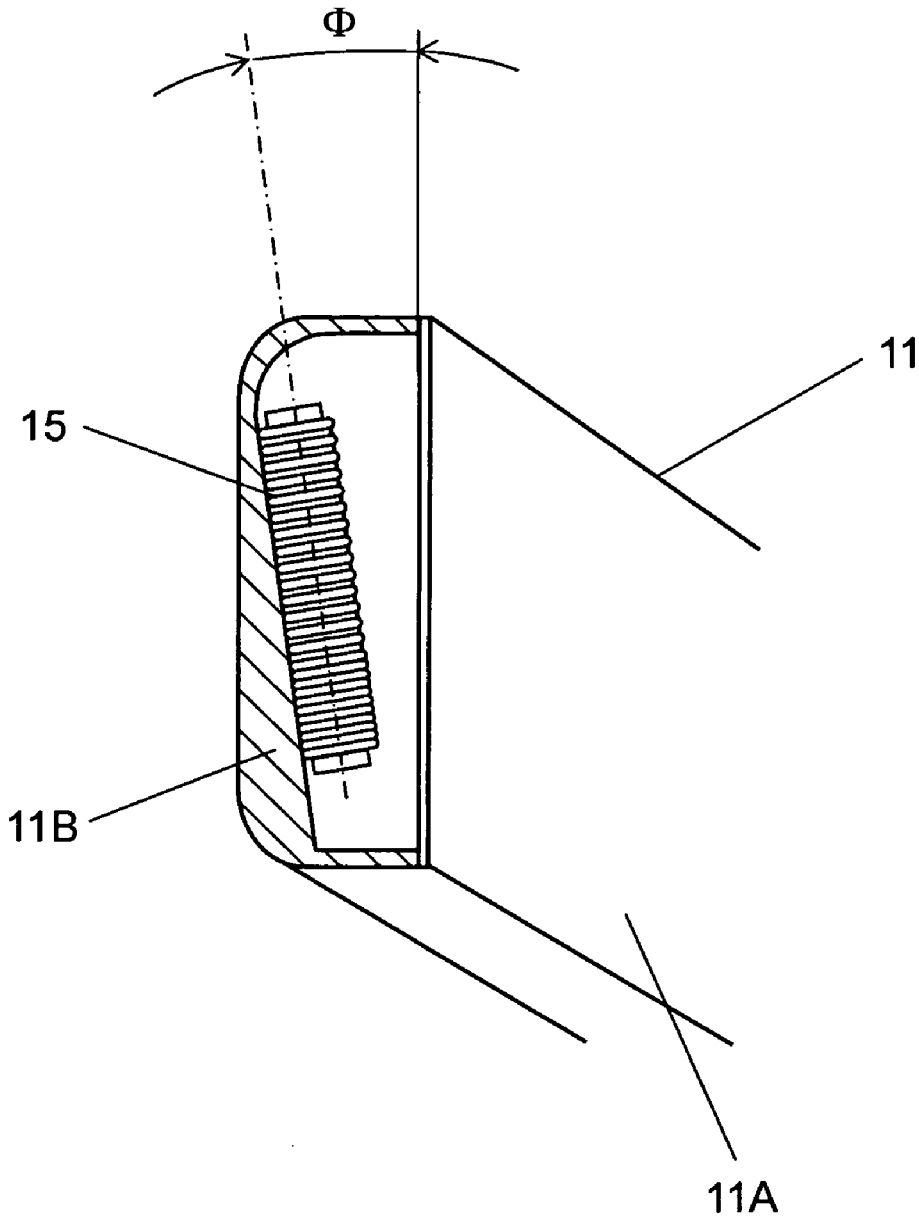
FIG. 2 is a sectional perspective view of an antenna device in a preferred embodiment of the present invention.

FIG. 1 is a fragmentary sectional view of an antenna device in a preferred embodiment of the present invention. FIG. 2 is a sectional perspective view of an antenna device in a preferred embodiment of the present invention. As shown in FIG. 1, columnar pillar 11 supporting roof of a vehicle is formed by combining a metallic member 11A on the outside of the vehicle body and resin member 11B inside the vehicle body. A generally cylindrical hollow space 11C is provided inside pillar 11.

Also, antenna 15 is formed by winding coil 14 around the periphery of rod-like core 13 made of a magnetic material. Antenna 15 is housed inside hollow space 11C of pillar 11 on the sides of the driver's seat and assistant driver's seat. Also, antenna device 20 is configured by arranging axis line B of the center of antenna 15 in a direction nearly orthogonal to vertical axis line A of pillar 11.

As shown in FIG. 2, a slope is provided on the inner surface of resin member 11B of pillar 11, and antenna 15 is disposed in the direction of thickness of pillar 11 at a predetermined tilt angle Φ. That is, antenna 15 is disposed in such a manner that the axis line of the center of antenna 15 is tilted by a predetermined angle Φ relative to the plane of metallic member 11A on the outside of pillar 11 of the vehicle body.

And, a capacitor (not drawn) and a fixed resistor (not drawn) are connected in series to coil 14, and antenna 15 is connected to a control circuit (not drawn) provided in the vehicle. A communications system is configured in such a way that the control circuit communicates with a portable device (not drawn) carried by a driver through antenna device 20.

The fixed resistor (not drawn) connected in series to coil 14 may be provided close to the control circuit (not drawn).

In the above configuration, when a driver having a portable device approaches a vehicle, the control circuit communicates with the portable device through antenna device 20. On identifying the driver, the control circuit operates a locking mechanism (not drawn) such as a solenoid to unlock the door.

The system is so configured that, when the driver having the portable device leaves from the vehicle thus disabling communication with the portable device, a locking mechanism is operated contrary to the above and the door is locked.

Figure 3:
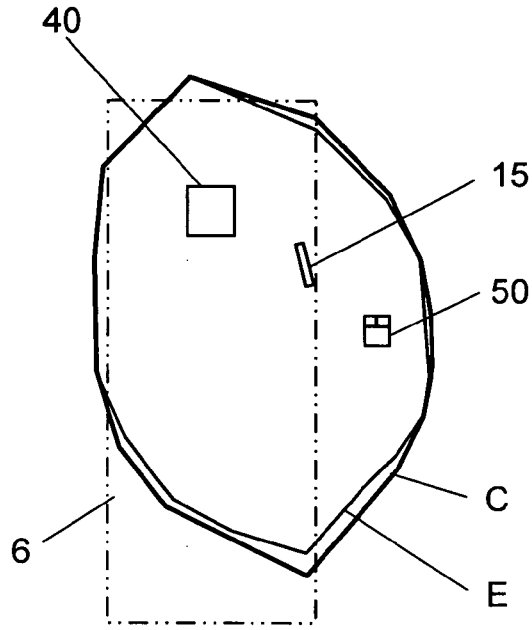
FIG. 3 is an antenna device and an example of a communications system using the antenna device in a preferred embodiment of the present invention.

Next, a description will be given on the configuration of an antenna device and a communications system using the antenna device in a preferred embodiment of the present invention. FIG. 3 is a diagram showing an exemplary configuration of the antenna device and the communications system using the antenna device in the preferred embodiment of the present invention. FIG. 3 also shows an example of directivity of an antenna device in the preferred embodiment of the present invention.

As shown in FIG. 3, the communications system in this preferred embodiment includes an antenna device further including antenna 15 housed in a hollow space of a pillar (not drawn) on the side of the driver's seat or assistant driver's seat of vehicle 6, control circuit 40 connected to the antenna device and portable device 50. Control circuit 40 is disposed in the front section inside vehicle 6 and portable device 50 is supposed to be carried by a driver (not drawn) standing outside of the vehicle.

When the antenna device is communicating with portable device 50, antenna 15 generates outward and inward magnetic fields C1, C2 with respect to pillar 11 as shown in FIG. 1. With the antenna device of this preferred embodiment, antenna 15 is housed inside pillar 11 having a relatively narrow width with the axis line B of the center of antenna 15 being oriented in a direction nearly orthogonal to vertical axis line A of pillar 11. Also, as that part of pillar 11 which faces vehicle interior is formed with resin member 11B and the width of metallic member 11A forming the exterior of the vehicle body is not so large as antenna 11, the electromagnetic waves radiated from antenna 15 are barely absorbed by vehicle 6 that includes metallic member 11A of pillar 11 and radiated to inside and outside of the vehicle. Accordingly, the electromagnetic waves are radiated from antenna 15, and communication range C in which communication with portable device 50 is possible is formed as shown in FIG. 3.

In other words, by housing antenna 15 inside pillar 11 with a relatively small width different from doors formed of metallic chassis, and disposing antenna 15 in a nearly orthogonal direction to vertical direction of pillar 11, the electromagnetic waves can be radiated to the inside of a vehicle cabin as well as to the outside of vehicle 6. Accordingly, a single antenna 15 enables communication with a driver carrying portable device 50 not only when the driver is outside of the vehicle but also when in the vehicle cabin.

Also, as the electromagnetic waves radiated from antenna 15 are barely absorbed by the vehicle body, the antenna current necessary for securing a predetermined communication range can be small and saving of electric power can be achieved.

For example, in the communication range C shown in FIG. 3, suppose antenna 15 is disposed inside pillar 11 on the driver's seat side of a vehicle at a height of 1.3 m and an antenna current of 0.5 A at 125 kHz operating frequency is supplied from a control circuit, an external communication range of about 1 m in radius is obtained. That is, an equal communication range can be obtained with an antenna current about half that of an antenna housed inside a door knob, for example.

While pillar 11 is normally positioned in a range of 1 m to 1.5 m from the ground, it is preferable to dispose antenna 15 in approximately the center of pillar 11 at a height of 1.2 m to 1.4 m at an angle of 90 degrees +/−10 degrees with respect to pillar 11.

Also, by adjusting the housing position of antenna 15 inside pillar 11 so as to obtain a communication range of about 90 degrees relative to axis line B of the center of antenna 15 toward the front wheels and about 20 degrees toward the rear wheels, the area between the front wheels and the rear wheels, namely, the range between the front and rear doors usually used for getting on and off can be obtained as the communication range.

Furthermore, by tilting antenna 15 in the direction of thickness of pillar 11 by a predetermined angle Φ, a wider communication range outside the vehicle and inside the cabin can be obtained. For example, by disposing antenna 15 at a predetermined tilt angle Φ equal to 10 degrees, a communication range C enlarged by about 15% in average radius compared with communication range E of no tilting is obtained as shown in FIG. 3. That is, by disposing antenna 15 in a manner such that the axis line of its center is tilted at a predetermined angle Φ of 10 degrees relative to the front of a vehicle, a wider communication area C is obtained. Here, the predetermined angle Φ is not limited to 10 degrees. In view of various conditions such as the distance between antenna 15 and the plane of metallic member 11A that forms exterior of a vehicle, or the width of metallic member 11A, an appropriate tilting angle may be chosen. The range of the predetermined angle is preferably 5 degrees to 30 degrees.

As has been described, according to this preferred embodiment, by housing antenna 15 obtained by winding coil 14 around the periphery of rod-like core 13 made of a magnetic material inside pillar 11 with a relatively narrow width different from vehicle doors, and disposing antenna 15 in a manner such that its axis line is nearly orthogonal to the vertical axis line of pillar 11, a predetermined communication range is secured in which the electromagnetic waves radiated from antenna 15 are barely absorbed by the vehicle body and radiated to within vehicle cabin as well as to the outside. Accordingly, an inexpensive antenna device which is capable of communicating with portable device 50 inside or outside a vehicle using a single antenna and a communications system using the antenna device can be obtained.

Figure 4:
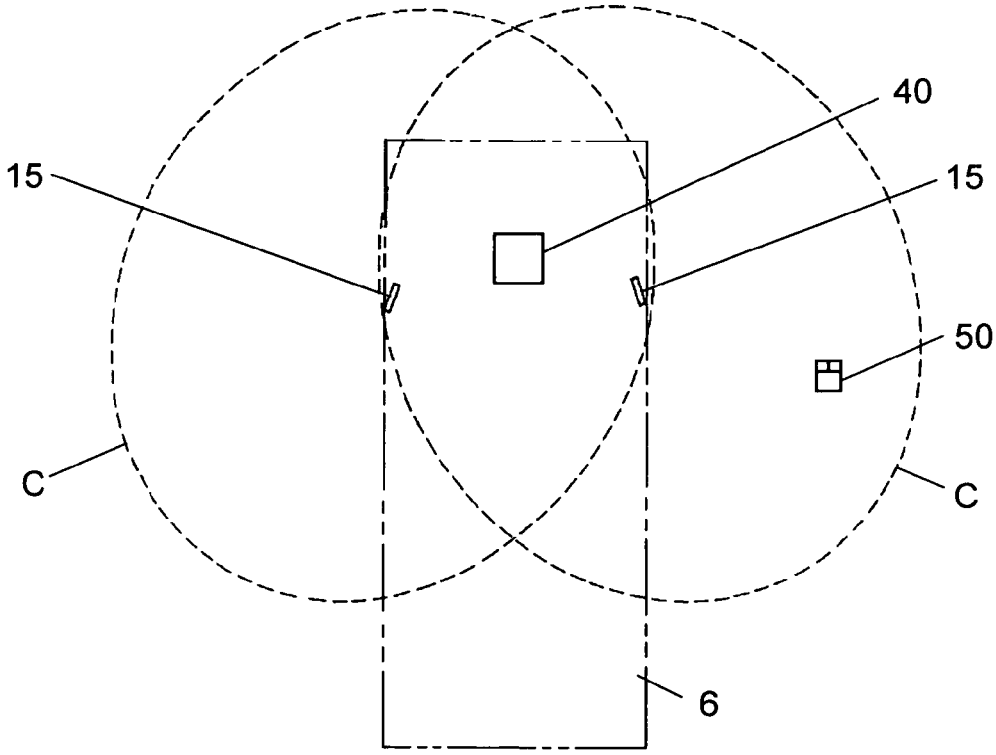
FIG. 4 is a diagram showing an example of directivity characteristics of an antenna device in a preferred embodiment of the present invention.
Figure 5:
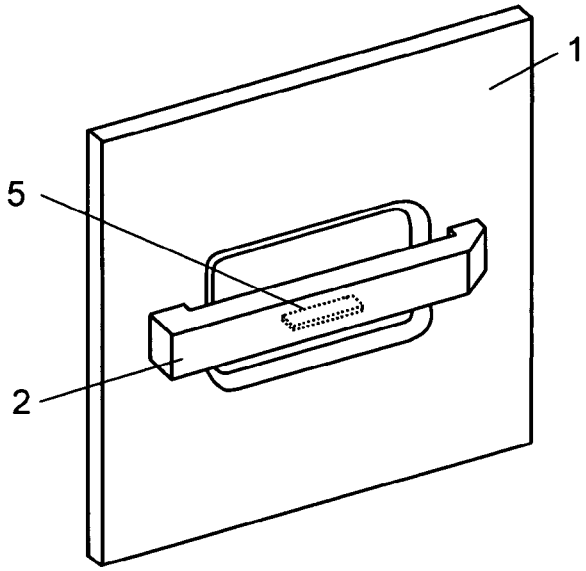
FIG. 5 PRIOR ART
FIG. 5 is a perspective view of a conventional antenna device.
Figure 6:
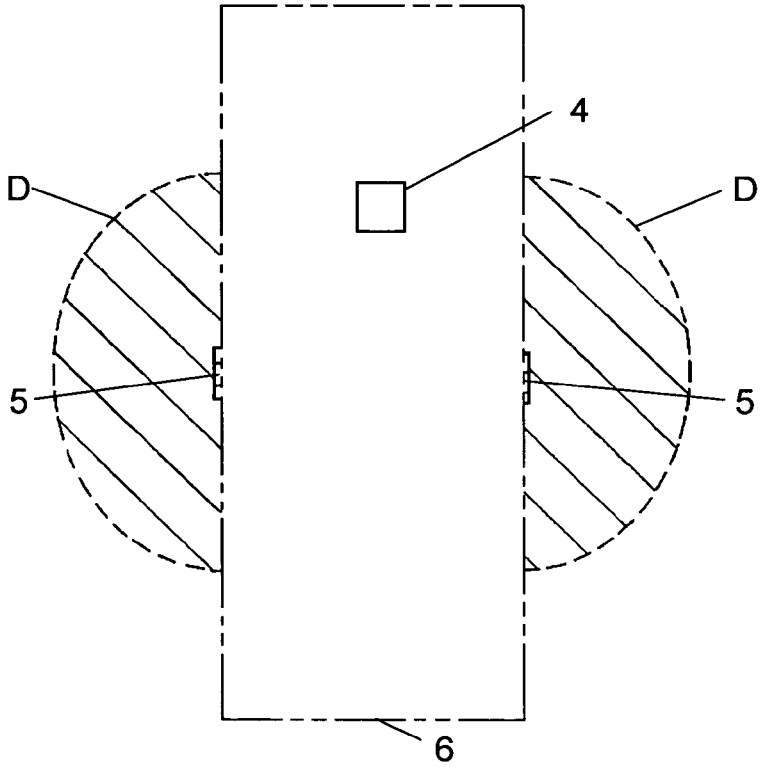
FIG. 6 PRIOR ART
FIG. 6 is a diagram showing a conventional antenna device and an exemplary configuration of a communications system using the antenna device.

FIG. 4 shows an example of directivity characteristics of an antenna device in a preferred embodiment of the present invention. As shown in FIG. 4, antenna 15 is housed in a hollow space in the pillar (not drawn) on the sides of both the driver's seat and assistant driver's seat of vehicle 6 and control circuit 40 is disposed in the vicinity of a front section inside vehicle 6. Also, antenna 15 is disposed at a predetermined tilt angle Φ in the direction of thickness of pillar 11, and portable device 50 is supposed to be carried by the driver (not drawn) standing outside of the vehicle.

As shown in the drawing, by housing more than one antenna 15 inside each of more than one pillar (not drawn) provided on vehicle 6, a directivity characteristics diagram as shown in FIG. 4, for example, is obtained. By disposing antenna 15 in each of the pillars on the sides of the driver's seat and the assistant driver's seat, communication range C is expanded by the combination of more than one antenna 15. Accordingly, control circuit 40 can communicate with portable device 50 in a wider range inside and outside the cabin.

In the above, although a description of a so-called smart entry system is given in which control circuit 40 and portable device 50 communicate each other, the present invention can also be practiced in a so-called keyless system in which doors can be locked or unlocked by transmitting a signal to a control circuit by push-button operation on a portable device provided with a push-button.

What is claimed is:

1. An antenna device used for a vehicle having a pillar formed by combining a metallic member on an outside of the vehicle body and a resin member inside the vehicle body, the antenna comprising:

a rod-like core made of a magnetic material; and a coil wound on a periphery of the rod-like core, wherein the antenna is housed inside a pillar of the vehicle and the antenna is housed in a manner such that an axis line of the antenna is orthogonal to an axis line in a longer direction of the pillar.

2. The antenna device of claim 1, wherein the antenna is disposed with the axis line of the center thereof tilted by a predetermined angle relative to a plane of a metallic member of the pillar forming an exterior of the vehicle.

3. The antenna device of claim 1, wherein the antenna is housed inside each of more than one pillar provided on the vehicle.

4. A communications system including the antenna device of claim 1, a control circuit connected to the antenna device and a portable device to be carried, wherein the control circuit and the portable device communicate through the antenna device.

* * * * *